United States Patent [19]

Septier

[11] 4,123,054

[45] Oct. 31, 1978

[54] TENNIS RACKET FRAME

[76] Inventor: Jacqueline Septier, 9, rue Lentonnet, Paris, France, 75009

[21] Appl. No.: 663,066

[22] Filed: Mar. 2, 1976

[30] Foreign Application Priority Data

Mar. 4, 1975 [FR] France ..... 75 06736

[51] Int. Cl.[2] ..... A63B 49/10

[52] U.S. Cl. ..... 273/73 F; 273/75

[58] Field of Search ..... 273/73 R, 73 C, 73 F, 273/73 G, 73 J, 73 K, 75, 80 R, DIG. 7, DIG. 23; 280/610

[56] References Cited

U.S. PATENT DOCUMENTS

| | | | |
|---|---|---|---|
| 1,636,867 | 7/1927 | Robinson | 273/73 K |
| 2,878,020 | 3/1959 | Robinson | 273/73 F |
| 2,923,652 | 2/1960 | Oka | 273/DIG. 7 |
| 3,606,326 | 9/1971 | Sparks et al. | 273/75 X |
| 3,690,658 | 9/1972 | Howe | 273/73 C |
| 3,755,037 | 8/1973 | Erwin et al. | 273/73 F X |
| 3,787,051 | 1/1974 | Johns | 273/73 F |
| 3,833,218 | 9/1974 | Frenkel et al. | 273/73 J |
| 3,905,598 | 9/1975 | Ballog | 273/75 |
| 3,930,920 | 1/1976 | Kicherer | 273/73 F X |
| 3,949,988 | 4/1976 | Staufer | 273/73 F |
| 4,013,290 | 3/1977 | Stevens | 273/73 E |

FOREIGN PATENT DOCUMENTS

| | | | |
|---|---|---|---|
| 1,942,082 | 3/1971 | Fed. Rep. of Germany | 273/73F |
| 2,153,172 | 5/1973 | Fed. Rep. of Germany | 273/73 F |
| 2,338,436 | 2/1974 | Fed. Rep. of Germany | 273/73 F |
| 2,337,851 | 2/1975 | Fed. Rep. of Germany | 273/73 F |
| 359,227 | 10/1931 | United Kingdom | 273/73 E |
| 1,122,895 | 8/1968 | United Kingdom | 273/DIG. 7 |
| 1,304,015 | 1/1973 | United Kingdom | 273/73 F |
| 1,311,287 | 3/1973 | United Kingdom | 273/DIG. 23 |
| 1,312,543 | 4/1973 | United Kingdom | 273/73 F |
| 1,349,906 | 4/1974 | United Kingdom | 273/73 F |
| 1,362,116 | 7/1974 | United Kingdom | 273/73 F |

*Primary Examiner*—Richard J. Apley

*Attorney, Agent, or Firm*—Kane, Dalsimer, Kane, Sullivan and Kurucz

[57] ABSTRACT

A racket frame made of reinforced plastic is manufactured wherein the reinforcement is constituted by two carbon fiber strips around which are braided glass fiber strings in order to confer the frame both a lattice beam and a tubular beam structure, said reinforcement extending inside the heart and the handle of the racket.

9 Claims, 15 Drawing Figures

TENNIS RACKET FRAME

This invention has for its object a tennis racket frame for tennis, badminton and analogous games.

It has already been suggested to construct a tennis racket frame from plastic reinforced by glass fiber.

This invention has for its object a frame of this type but presenting a higher resistance than the known frames, on one hand, by the fact that it comprises carbon fibers and, on the other hand, by the fact that the glass fibers are braided around the longitudinally disposed carbon fibers in such a way as to give the armature of the frame simultaneously a closed beam configuration and a lattice beam configuration, said configurations enabling the frame to resist forces exerted on it better than do the known frames.

In the following description given as an example reference is made to the appended drawing in which.

Figures 1, 2, 3, 4, 5, 6, 7, 8, 9, 10:
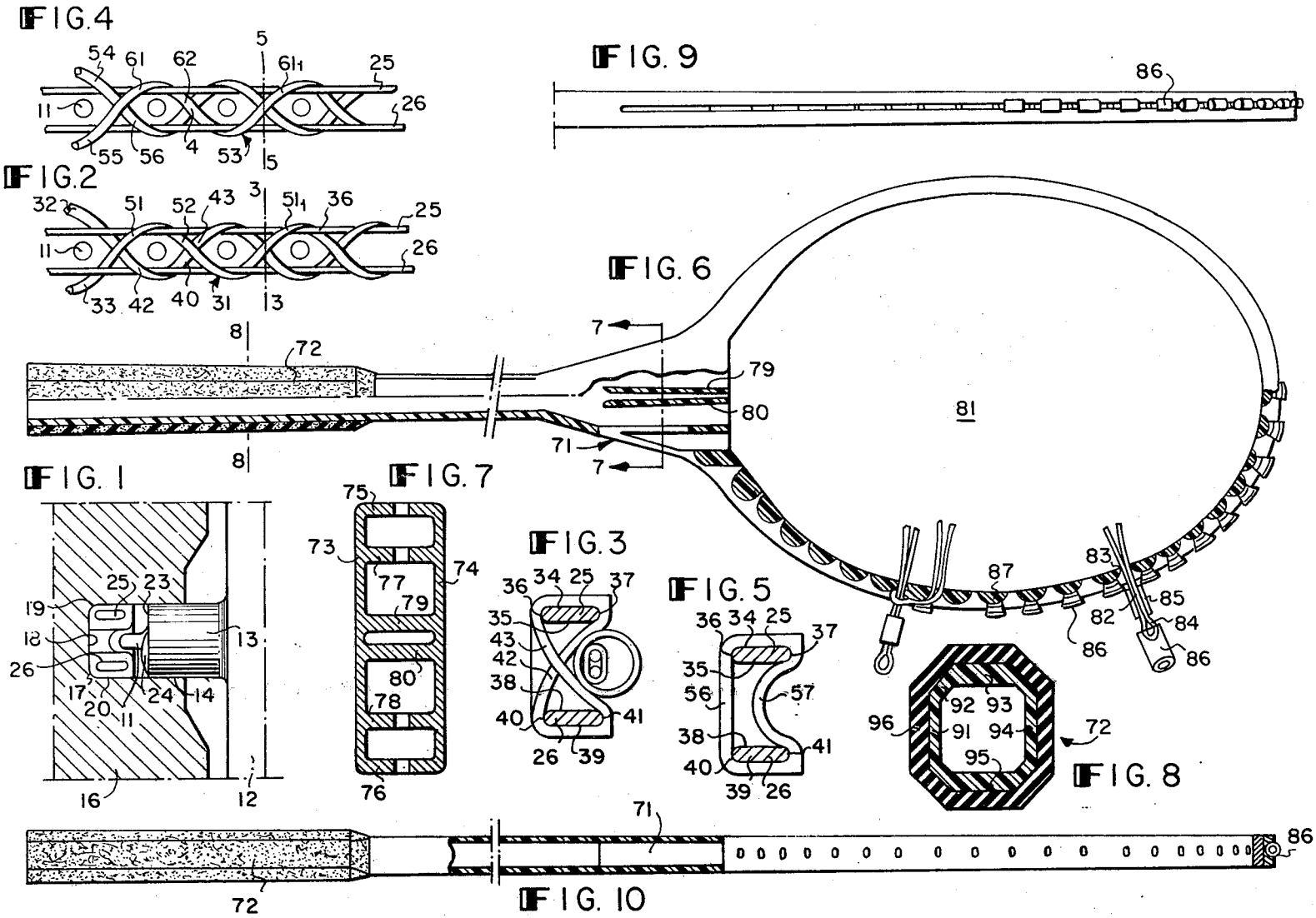
FIG. 1 is a schematical view of part of a mould for manufacturing the racket frame.
FIG. 2 is a schematical view of part of the armature of the frame during a maufacturing phase.
FIG. 3 is a cross-sectional view along line 3—3 of FIG. 2 with the scale somewhat enlarged.
FIG. 4 is a view analogous to FIG. 2 but during of another manufacturing phase.
FIG. 5 is a cross-sectional view along line 5—5 of FIG. 4.
FIG. 6 is a view of the whole of the frame with partial tearings during the placing of a net, some of the cords having been omitted for the clarity of the illustration.
FIG. 7 is a sectional view along line 7—7 of FIG. 6 but to a larger scale.
FIG. 8 is a sectional view along line 8—8 of FIG. 6 but to a larger scale.
FIG. 9 is an edge view of the racket corresponding to FIG. 6 without the handle.
FIG. 10 is an edge view of the frame of the racket with partial sections.

The maufacturing of the frame is made in a mold which comprises pins 11 (FIG. 1) which are provided in a movable component of the mould 12, preferably in many parts, the disposition of the pins 11 corresponding to that of the holes that the frame must present to allow passage for the catgut or other stringing material. The body 13 of the pins cooperate with walls 14 provided in a second element of mould 16 defining a cavity 17 with incurved configuration corresponding to the outline of the frame to be manufactured. The cavity 17 or lodging is limited by an internal surface 18, lateral surfaces 19 and 20 and shoulders 23 and 24 of the element of mould 12 on each side of the pins 11.

In the cavity 17 are placed two strips 25 and 26 of carbon fibers near the surfaces 19 and 20 and the greater dimension of these strips is parallel to said surfaces.

These strips serve as core to a first braiding 31 (FIG. 2) which makes use of two strings of glass fiber 32 and 33. In the configuration represented in FIGS. 2 and 3 the carbon fiber strip 25 is the upper strip and the strip 26 is the lower strip.

The strip 25 with generally rectangular cross-section has an upper side 34 and a lower side 35, an internal edge 36 and an external edge 37.

Similarly, the strip 26 has an upper side 38 and a lower side 39, an internal edge 40 and an external edge 41.

The string 32 is placed in such a manner as to be first in contact with the external edge 37 of the strip 25 then with the internal edge 40 of the strip 26 forming between the edges an oblique strand 42; it is then applied against the lower edge 39 of the strip 26 and, is in contact with the external edge 41 of the latter. It then forms a second oblique strand 43, is put into contact with the internal edge 36 of the upper strip 25, is applied against the upper edge 34 of the latter, then again against the external edge etc. following thus a sinuous path with crossings as is well shown in FIGS. 2 and 3.

The disposition of the glass fiber string 33 is analogous but whereas the winding of one string is clockwise, the winding of the other string is counterclockwise. The string 33 starting from the left hand side of FIG. 2 is in contact with the external edge 41 of the strip 26, is disposed according to an oblique strand 51, is in contact with the internal edge 36 of the strip 25, is applied against the upper side 34 of the latter, then against the external edge 37. It then forms a new oblique strand 52, is put in contact with the second internal edge 40 of the strip 26, is applied against the lower side 39 of the latter, then against the internal edge 41, forms a new oblique strand $51_1$, etc.

Upon this double braiding 31 is effected a second double winding 53 (FIGS. 4 and 5) by means of two glass fiber strings 54 and 55. (On the FIGS. 4 and 5, for the sake of clarity, the double braiding 31 has been omitted). String 54 after its contact with the internal edge 36 of the carbon fiber strip 25 is disposed so that it is in contact with the internal edge 40 of the strip 26 forming thus a strand 56 which is not diagonal in FIG. 5 in opposition to strand 43 of the braiding 31; string 54 is then applied against the lower side 39 of the strip 26 against the external edge 41 of the latter and then following a curved but not diagonal path 57 (FIG. 5), is put into contact with the external edge 37 of the strip 25, is applied against the upper side 34 of said strip, then against the internal edge 36 whence it follows a new circuit analogous to that which has just been described.

String 55 follows a circuit analogous to that of string 54 but instead of being wound in the same direction as string 54, it is wound in the opposite direction. Thus string 55, after having been in contact with the internal edge 40 of the lower strip 26, comes into contact with the internal edge 36 of the upper strip 25, is applied against the upper side 34 of the latter, is in contact with the external edge 37 of said strip 25. It then forms a strand 62, comes into contact with the external edge 41 of the strip 26, is applied against the lower side 39 of said strip, comes into contact with the internal edge 40 of the latter, then again is disposed according to a strand $61_1$ parallel to strand 61, etc.

The glass fiber strings 32, 33, 54, 55, are impregnated with resin before they are positioned.

The section of the strings, the spacing of their winding or braiding are chosen such that taking into account the penetration of the pins 11 they fill the internal volume of the mould constituted by the assembly of the mould elements 12 and 16.

After moulding and hardening of the resin, a racket frame basket is obtained having an exceptional resistance. This is due not only by the presence of the carbon fiber strips but also by the double braiding of the glass fiber strings, one of the braidings being crossed and giving a resistance similar to that provided by the diagonal lattices of a double beam and the other braiding being enveloping and confering a resistance similar to that of a tubular beam.

By moulding are obtained not only the basket of the frame but also the heart 71 and the handle 72 (FIG. 6), the strips of carbon fibers, as also the braiding 31 and the braiding 53, extending inside the heart 71 and along the handle 72.

For the constitution of heart 71 by moulding, impregnated glass fiber materials are used and the heart has a compartment-type configuration as shown in FIG. 7 with two parallel walls 73 and 74 joined by end-walls 75 and 76 with intermediate partitions 77, 78 and 79, 80.

For the assembly of a net 81 within the frame a strand 82 of the net resulting from the juxtaposition of two catguts or the like is passed through a hole 83, provided by the pins 11, said strand forming at its extremity a loop 84. A retractable sheath 85 covers the strand 82 adjacent to the loop and receives a ring 86 made of resistant plastic which is pushed back until it covers up sheath 85. Thereafter, the loop is bent towards the handle allowing the ring 86 to rest on the convex surface 87 formed during the moulding process. The loop 84, before being bent towards the handle, is introduced through the adjacent preceding loop 84 as shown in FIG. 6. The assembly of the strands in one another is thereby obtained in a step by step manner up to the inferior strands, i.e. the nearest ones to the heart 71.

The tensing of the net can be accomplished through two different steps taken together or individually. One can either put the inferior strings under tension, and/or apply tension to some of the strings of the net, particularly the upright strings ending near the heart 71 of the racket. In the latter case, passages are provided for the uprights in the heart. The end of these strings may be attached to a movable carriage within the heart which is moved away from the net to provide the tensing force.

The handle, the body of which is constituted by moulding according to a hollow body assembling the carbon fiber strips 25 and 26 as well as the braidings 31 and 53 is formed according to a hexagonal wall 91–95 and, according to this invention, said hexagonal body is, by moulding, covered with a layer of rubber foam 96.

The rings 86 are provided only for the upper half of the basket and serve to protect the frame, especially against the effects of a friction on the ground.

Figure 11:
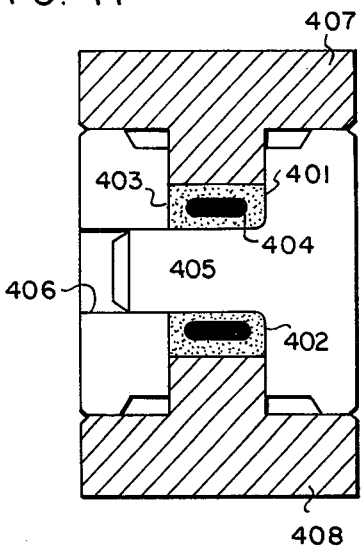
FIG. 11 is a schematical cross-sectional view of a mould.
Figure 12:
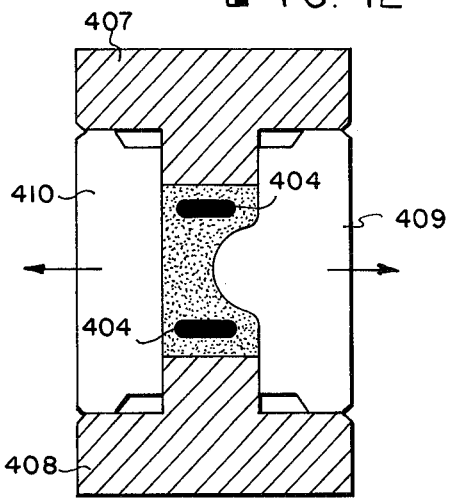
FIG. 12 is a view analogous to FIG. 11 but for another cross-section.

In the embodiment shown in FIGS. 11 and 12, the annular cavities of the mould 401 and 402 are filled with mouldable material 403 after having been first filled with a reinforcement 404. The punch 405 cooperating with the counter-punch 406 defines the interval for the passage of the connection loops between neighbouring cords.

FIG. 12 is a cross-sectional view showing the moulding for the part of the frame which is not facing such an interval, the moulding cavity being defined by the two parts of the mould 407 and 408 and by the mandrels 409 and 410 which comprise respectively the punch 405 and the counter-punch 406.

Figure 13:
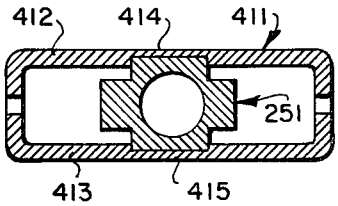
FIG. 13 is a schematical view in cross-section of the heart of the frame.

For a frame obtained by moulding, a heart 411 is provided (FIG. 13) which, shaped as a compartment or shell, presents on its facing walls 412 and 413 grooves 414 and 415 for the guiding by sliding of a carriage 251 used for the tension of the net by means of the traction exerted by a conventional extensor means lodged inside the handle. This embodiment differs from that shown in FIG. 7 in that one or more of the intermediate partitions 77, 78 and/or 79, 80 have been suppressed to provide sufficient moving space for the sliding carriage. Shell 411 is formed, however, in the same manner as shell 74.

Figure 14:
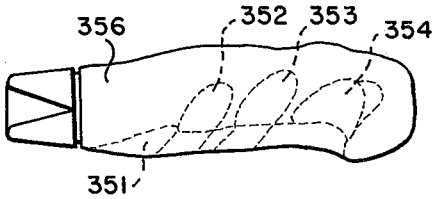
FIG. 14 is a schematical view of the handle of the racket.
Figure 15:
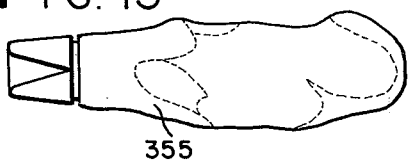
FIG. 15 is a view analogous to FIG. 14 but by the opposite side.

The invention provides a handle 350 (FIGS. 14 and 15) preferably in foam material, which presents cavities or cut out portions matching the shape of the fingers of a hand firmly holding the racket. A cut out portion 351 is provided for the lodging of the index, a cut out portion 352 for the lodging of the major, a cut out portion 353 for the lodging of the annulary and a cut out portion 354 for the lodging of the little finger. The handle presents a flat part 355 conceived to place the thumb. Another flattened out portion 356 is provided to place the thumb when the latter snatches the handle.

What is claimed is:

1. A racket frame forming a head, a heart, and a handle, said head defining a middle plane co-extensive to the striking surface, comprising:

two strips extending along the frame in parallel relationship and symmetrically with respect to the middle plane, in order to form a frame reinforcement;

at least one resin impregnated glass fiber string wound along said reinforcement and resting alternatively on one strip and on the other, in order to form a braiding encircling passage for netting strings; and said braiding comprising a first crossed braiding, a string passing from the internal edge of a strip to the external edge of the other strip and reciprocally, and a second braiding according to which a string passes from the external edge of a strip to the external edge of the other strip, then from the internal edge of said strip to the internal edge of the first strip, this pattern repeating itself along the reinforcement.

2. A frame according to claim 1, wherein each braiding comprises two strings one of which is wound in one direction and the other one in the other direction.

3. A frame according to claim 1, wherein said strips extend inside the heart and also in the body of the handle.

4. A frame according to claim 3, wherein said glass fiber strings extend inside the heart and also in the body of the handle.

5. A frame according to claim 4, wherein said strips and said glass fiber strings constitute the reinforcement of the body of the handle.

6. A frame according to claim 4, wherein the heart further comprises glass fiber material.

7. A frame according to claim 4 wherein the handle is coated with a layer of rubber foam, said layer being moulded together with the frame.

8. A frame according to claim 7, wherein the coating of the handle comprises cut out portions, the shapes and positions of which correspond to those of the fingers of the hand holding tight the racket during the game.

9. A frame according to claim 4, wherein the heart includes a hollow cavity limited by internal surfaces, said cavity receiving a net tensioning element movable in said cavity, the internal surfaces of said cavity forming guiding paths for said element.

* * * * *